US005732851A

United States Patent [19]

Griffin et al.

[11] Patent Number: 5,732,851

[45] Date of Patent: Mar. 31, 1998

[54] DETACHABLE BEVERAGE CAN ATTACHMENT

[76] Inventors: Patrick J. Griffin, 20361 Bonnie Bank Blvd., Rocky River, Ohio 44116; Steven M. Fenker, 5057 Cambrian Dr., Columbus, Ohio 43220

[21] Appl. No.: 624,963

[22] Filed: Mar. 29, 1996

Related U.S. Application Data

[63] Continuation-in-part of Ser. No. 460,657, Jun. 2, 1995, abandoned.

[51] Int. Cl.[6] ..... B65D 25/22; B65D 25/28

[52] U.S. Cl. ..... 220/737; 220/903; 220/906; 220/710.5; 220/759

[58] Field of Search ..... 220/710.5, 716, 220/717, 718, 719, 703, 737, 739, 740, 741, 742, 759, 903, 906, 287

[56] References Cited

U.S. PATENT DOCUMENTS

| | | | |
|---|---|---|---|
| D. 329,604 | 9/1992 | Kuczer . | |
| 2,294,393 | 9/1942 | Erne | 220/737 |
| 2,802,609 | 8/1957 | Donovan . | |
| 2,838,202 | 6/1958 | Huether | 220/759 |
| 2,881,952 | 4/1959 | Dungey | 220/703 |
| 3,014,621 | 12/1961 | Povitz | 220/703 |
| 3,239,113 | 3/1966 | Knize | 220/287 |
| 3,850,341 | 11/1974 | Bart | 220/287 |
| 3,907,172 | 9/1975 | Curtis . | |
| 3,979,011 | 9/1976 | Schleicher | 220/742 |
| 4,054,205 | 10/1977 | Blow, Jr. et al. . | |
| 4,098,439 | 7/1978 | Blow, Jr. et al. . | |
| 4,120,073 | 10/1978 | Studebaker . | |
| 4,602,723 | 7/1986 | DeMars . | |
| 4,715,510 | 12/1987 | van der Meulen et al. . | |
| 4,717,037 | 1/1988 | van der Meulen et al. | 220/703 |
| 5,062,552 | 11/1991 | Heubel | 220/287 |

FOREIGN PATENT DOCUMENTS 865259 4/1961 United Kingdom .

OTHER PUBLICATIONS

Sip 'N Seal Caps for cans, made in China for Maverick Ventures, Inc., St. Louis, MO 63017, copies of front and back of "blister card" package within which 2 caps were sold, one of the 2 apparently identical (except for color) caps in the package is also enclosed, the package with caps was purchased in the United States in Mar. 1996.

Photos (front and back) of cap purchased in the United States in Jul. 1995. This cap is identical (except for color) to the cap enclosed and referenced in R above.

*Primary Examiner*—Stephen J. Castellano

*Attorney, Agent, or Firm*—Pearne, Gordon, McCoy & Granger LLP

[57] ABSTRACT

A one-piece detachable drinking attachment for use with metal beverage cans comprising a top portion having a substantially cylindrical wall, an integral base that has a plurality of annular gripping collars of different diameters, for obtaining a substantially liquid-tight connection among various can top diameters, and an approximately C-shaped integral handle, so that when such drinking attachment is attached to a beverage can, the fluid contents of the can flow to the drinker. An optional configuration is also disclosed that further includes the emergence of a substantially cylindrical skirt from along the base extending downward from the exterior circumference of the base along the outer sidewall of the beverage can, and an approximately C-shaped integral handle emanating from the outer wall of the smoothly curved top portion extending downward along the outer wall of the skirt to a point at which the bottom of the handle reunites with the skirt.

14 Claims, 3 Drawing Sheets

DETACHABLE BEVERAGE CAN ATTACHMENT

This is a continuation-in-part of application Ser. No. 08/460,657, filed Jun. 2, 1995, now abandoned.

FIELD OF THE INVENTION

This invention relates to a detachable beverage can attachment, specifically an improved one-piece attachment with a handle, which can be mounted and released from a plurality of beverage can diameters while also providing a means for blocking or restricting the viewing of the trademark or logo of the can and providing, instead, a substitute surface which would be conducive to the affixing of promotions or advertisements such as characters, logos, and trademarks.

BACKGROUND OF THE INVENTION

Numerous types off beverages are sold in cans that are similar in shape and design but which vary in diameter, particularly top rim diameter, among various can manufacturers. Throughout their history, the beverage industry, in cooperation with the can manufacturers, have experimented with various can sizes for packaging soft drinks, beer, and the like. The cans have varied in such ways as volume (12 ounces and 16 ounces, e.g.), as well as height, body and top circumference, etc. Although various can sizes have been tried throughout the years, presently the beverage industry has three primary can sizes, most commonly referred to, and differentiated by, the can top diameter. The can top diameters most commonly utilized today are the 202, which has a can top diameter (the outside diameter of the rim at the top of the can) of approximately 2⅛ inches; the 204, which has a can top diameter of approximately 2¼ inches; and the 206, which has a can top diameter of approximately 2⅜ inches.

These cans are typically constructed of aluminum, are most often sealed by an upstanding rim at the top end of the can, with said rim forming a bead along the outer circumference of the top, and provide an attached means upon the can top in which to manually open the can in order for the contents to be consumed directly out of the beverage can. Unless the driver takes the intermediate step of transferring the liquid into another drinking container, the liquid contents within the container cabot be consumed without the driver coming into direct oral contact with the can.

The disadvantage of transferring the contents into substitute containers is mainly one of inconvenience under such circumstances and venues as picnics, barbecues, boating, and the like. In such cases the consumers of canned beverages who would be adverse to the idea of driving directly from a can that may be dirty would be required to transport substitute drinking devices to and from alternative locations rising these devices to loss and breakage.

The disadvantages of drinking directly from the beverage can are well documented and understood. The beverage can itself is most likely unsanitary as a result of inconspicuous hazards such as bacteria, viruses, and other microorgasms, as well as more obvious contaminants as dirt, insects, grease, and the like attaching themselves to the can during manufacturing, packaging, transportation, storage, shelf display, etc. These contaminants are most likely to be located atop the beverage can, often imbedded in and along the channel or groove formed at the intersection of the upper rim and the can top. These are areas in which the lips and mouth of the consumer come in direct contact with the can. Most people are so repulsed by the idea of this means of consumption that they will often make even the most rudimentary attempt to clean the can top, such as running a fingertip along the upper rim. Unfortunately, this is as ineffective a sanitation method as a child who wipes a bottle top with his hand after sharing such with a friend. These and other similar methods are an acknowledgment, both conscious and subliminal, of a consumer's discomfort with so unsanitary a means of consumption. Although the aforementioned mainly gives rise to only unpleasant perceptions and reactions by the consumer, there is also the very real hazard and undesirable consequence from direct contact with the can as it can lead to many types of infection and contamination, as well as abrasions and cuts to the mouth of the drinker.

Furthermore, other consumers of canned beverages such as children, the elderly, and the disabled, may have difficulty grasping a can or many of the substitute containers because their grips may be too weak or their channels are too small relative to the circumference of each.

Heretofore, these problems have been addressed in the prior art concerning attachments which have been designed for facilitating the drinking of liquids contained in beverage cans, or similar pouring attachments, so that, for example, the mouth of the drinker does not have to come in direct contact with the beverage can. Thus, U.S. Pat. No. 2,802,609 to Donovan discloses a pouring attachment of general utility, most often to a paint can or pail, consisting of a circumferential channel that engages an interior horizontal rim of the can opening (which is recessed from the outer circumference of the can top) and whose sides extend upward from the recessed opening. This attachment appears to only be applicable to can tops which open along the majority of the top circumference, such as a paint can, but it does not appear to be adaptable to a beverage can-type opening in which the can opening is only a small portion of the entire can top. Similarly, British Pat. No. 865,259 to Johnston discloses a rim attachment for beverage cans in which a sleeve forms a circumferential groove on the interior surface of its base to receive and retain the rim of a can and which is fitted to the can allowing the contents to be easily poured. The type disclosed in U.S. Pat. No. 4,098,439 and U.S. Pat. No. 4,054,205 to Blow, Jr. et al is a spout that is attached to the can top and which is rotated to align the spout opening to the corresponding can opening. Such an arrangement has the dual purpose of a drinking attachment as well as a device for resealing an opened can, but has the serious drawback of being complicated and expensive to manufacture. Furthermore, numerous such attempts at resealing an opened carbonated beverage can have proven unsuccessful as the contents quickly go flat.

U.S. Pat. No. 4,717,037 to van der Meulen is a similar combination can top drinking device that has as one of its objectives the adaptation of the device to a variety of beverage cans, but which does so by employing an inner disk with an inner aperture that aligns with the can opening as a means of maintaining the liquid tight seal. Such a device fails to disclose a means of adapting to a plurality of can diameters and would seem especially incapable of accommodating cans that have a substantially inwardly tapering outer side wall immediately below the upper rim of the can, as is present in many beverage cans in present use. Also, such an arrangement would prove to be more costly and complicated to manufacture than a device that accommodates a variety of can diameters in one solid piece with no moving parts, as is taught in the present invention. U.S. Pat. No. 2,838,202 to Huether is a combination of a cup, base, and handle that is adjustable to accommodate cans of different heights but which makes no such allowances for cans of different circumferences.

These singular application attachments may apply to a plurality of beverage can diameters only through the manufacturing of multiple embodiments of detachable drinking attachments, each having a different diameter. This approach to the problem would add cost to the manufacturer in the form of producing and inventorying a variety of attachments, as well as for the end user in the form of multiple purchases if he or she wanted to have a detachable drinking attachment regardless of the can top diameter. Even if these obstacles were not an issue with the manufacturer or end user there would still remain the disadvantage of having to store and/or transport a variety of attachments.

Other prior art has been concerned with only allowing a means to hold such beverage containers by providing a handle of various designs. U.S. Pat. No. 4,602,723 to DeMars, U.S. Pat. No. 3,979,011 to Schleicher, and U.S. Pat. No. 4,120,073 to Studebaker each are typical of prior art that solely provides a means for a drinker to hold a beverage can but does not incorporate a top portion which would allow the drinker to avoid direct contact with the can top and the aforementioned disadvantages of such direct contact. Such devices have been concerned with merely providing a means to grasp a beverage can without regard to the issue of avoiding direct oral contact with a potentially dirty beverage can.

None of the prior art concerning any type of detachable drinking attachment or handle has incorporated any means by which the logo or artwork of the beverage can would be covered or obscured. To this end, incorporating a skirt from the top portion along the outer wall of the can would provide the multiple benefits of more stability through the lowering of the center of gravity of the drinking attachment, would shield the can from the warming effects of direct sunlight, as well as provide a substitute surface which would be conducive to the affixing of replacement logos, trademarks, and advertisements.

Therefore, it will be appreciated that the present invention shall provide that a consumer of canned beverages can safely imbibe the liquid contents directly from the can without coming into direct contact with the can and its many covert and obvious contaminants, but also provide a versatile, and economical means by which such a drinking attachment can be used in conjunction with a plurality of can diameters.

OBJECTS AND SUMMARY OF THE INVENTION

It is therefore an object of our invention to provide an improved, detachable, portable beverage can attachment.

It is another object of our invention to provide a means in which a consumer of a canned beverage product can comfortably and safely imbibe the contents without coming into direct oral physical contact with the can.

It is still a further object of our invention to provide a detachable beverage can attachment for use with various beverage can diameters while maintaining a substantially liquid-tight seal.

It is yet a further object of our invention to provide a detachable beverage can attachment that incorporates an approximately C-shaped handle.

An alternative embodiment of such an attachment would be fabricated from a non-toxic, molded, resilient material with smooth, rounded edges providing a comfortable means in which to sip or drink therefrom. One form of our invention would comprise a top portion with a substantially cylindrical wall and surfaces that are smoothly curved; the emanation of an approximately C-shaped handle from the exterior wall of said top portion, said handle extending downward along the outer sidewall of the can; and a base of multiple internal circumferences, each circumference having a different diameter, with multiple gripping collars or multiple clamping structures forming annular channels, or any combination of the foregoing, for the attachment to various can top circumferences (the top portion and base defining an aperture for the liquid beverage to flow through); which, when said drinking attachment is coupled with a beverage can, said attachment aligns approximately with the upper rim of said can and forms a substantially liquid-tight seal while supporting the weight of said can and its contents.

Yet another alternative embodiment would incorporate the immediate aforementioned with the addition of a skirt extending downward from said base of the top portion along the outer circumference of the can, and an approximately C-shaped handle which emanates from said top portion and which reunites with said skirt.

This form of the detachable beverage can attachment would have the added benefit of lowering the center of gravity of said beverage attachment making the can more stable and less likely to topple when said beverage attachment is coupled with the can top. This feature may be especially important as the can is emptied during the drinking process. When the C-shaped handle is reunited with the skirt in this way, it would have the added benefit of reducing the leverage such a handle would place on the top portion, thus ensuring the integrity of the substantially liquid tight seal.

This form of the detachable beverage can attachment would have the added effect of blocking or restricting the viewing of the trademark or logo of a beverage can being consumed and provide a substitute surface which would be conducive to the affixing of alternative advertisements and promotions such as characters, logos, and licensed trademarks.

This form of embodiment would also provide a desirable result of limiting the undesirable premature warming effect as a result of direct human contact by preventing any touching or contact of the human hand to a cold or chilled beverage can. Furthermore, such a skirt would conceal a beverage can to be consumed from direct sunlight thereby reducing the outdoor environment's natural warming effect.

Another form of our invention would allow the use of well-known or novel characters or likenesses to be molded, formed, or embodied into the top portion, the handle, the skirt, or any combination thereof, while also incorporating the multiple gripping collars or clamping structures, or any combination thereof, thus still allowing the liquid contained in the beverage can to flow to the drinker without the mouth or the surrounding areas of the drinker to come into direct contact with the can.

These objects of our invention are accomplished with the construction of a one-piece detachable drinking attachment comprising a top portion, a bottom portion and a middle portion. The top portion is shaped in horizontal cross section in the form of a mug-shaped drinking spout with smoothly-curved surfaces which transition into a base that contacts the top of a beverage can, and an integral C-shaped handle emanating from said top portion extending down along the outer wall of the can. The outer portion of said base is circular and conforms to the circular shape of the top of the beverage can, and having multiple concentric gripping collars or internal circumferences within said base consisting of a series of concentric clamping structures forming circumferential annular grooves, or any combination of the foregoing, whereby a substantially liquid-tight connection can be made to various can top diameters once the base is snapped on to the top rim of the can. In this way, the liquid contained within the beverage can flows directly to the drinker without the lips and mouth of the drinker coming into direct contact with the can. The close tolerances of these channels also provide a sufficiently strong seal allowing a full beverage can to be suspended from the device while the drinker lifts and pours the attachment to sip or Further therefrom.

Further objects and advantages of our invention will become apparent from a consideration of the drawings and ensuing description of it.

BRIEF DESCRIPTION OF DRAWINGS

Various features and embodiments of our invention are depicted in the accompanying drawings in which.

DETAILED DESCRIPTION OF THE PREFERRED EMBODIMENTS

Figure 1:
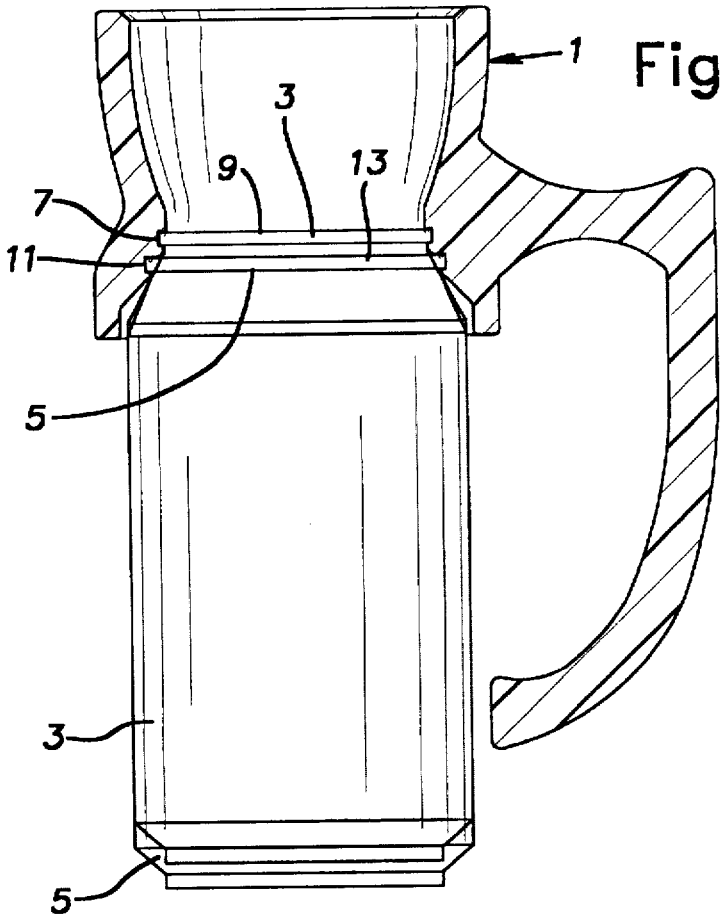
FIG. 1 is a cross-sectional view of one form of the present invention with integral C-shaped handle mounted on top of a beverage can, with a second beverage can having a different size top diameter superimposed thereon.

Referring now to FIG. 1 there is shown a detachable beverage can attachment 1 mounted atop a smaller sized top diameter beverage can 3 and a larger sized top diameter can 5. An annular gripping collar or upper annular circumference channel 7 within the substantially convex base is adapted to provide a snug and substantially liquid tight seal by receiving the top rim portion 9 of a smaller sized top diameter beverage can 3. An annular gripping collar or lower annular circumference channel 11 within the substantially convex base is adapted to provide a snug and substantially liquid tight seal by receiving a top rim portion 13 of a larger sized top diameter beverage can 5. The attachment 1 is adapted to be coupled, at different times, with the tops of cans 3 and 5.

Figure 2:
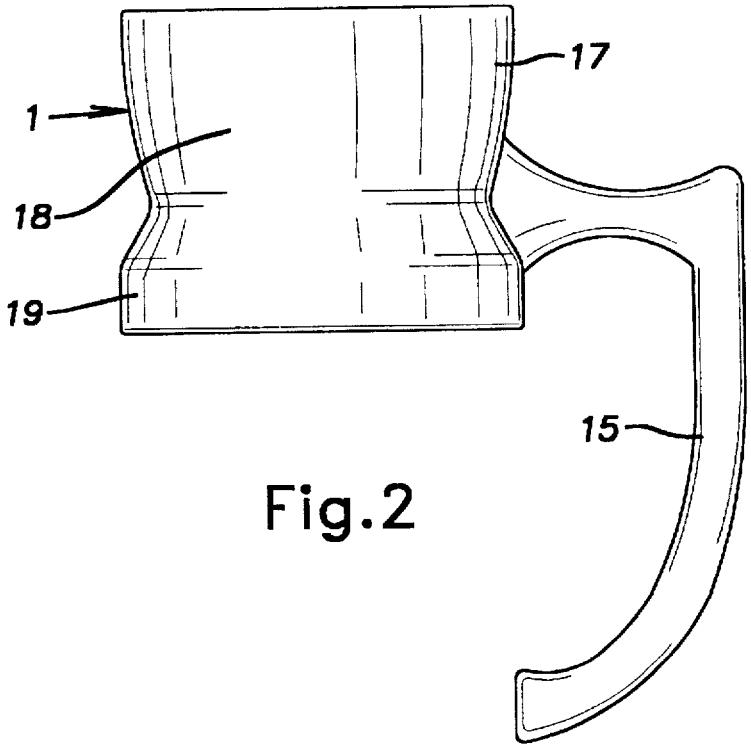
FIG. 2 is a side elevational view showing one form of our present invention with integral C-shaped handle.

Referring now to FIG. 2 an approximately C-shaped integral handle 15 is shown emanating from the transition section formed by the top portion 18 and a base 19 of a detachable beverage can attachment 1. An outer surface 17 of the top portion 18 is generally comprised of a smoothly-curved inwardly tapering cylindrical sidewall which concludes at the approximately convex shaped base 19. The C-shaped integral handle 15 comprises a downward projecting gripping portion outwardly spaced from the upper portion and extends downward, concluding at a point somewhat away from the outer wall of said various size top diameter beverage cans 3 and 5 as shown in FIG. 1. Top portion 18 can be differently configured so long as it performs the same function.

Figure 3:
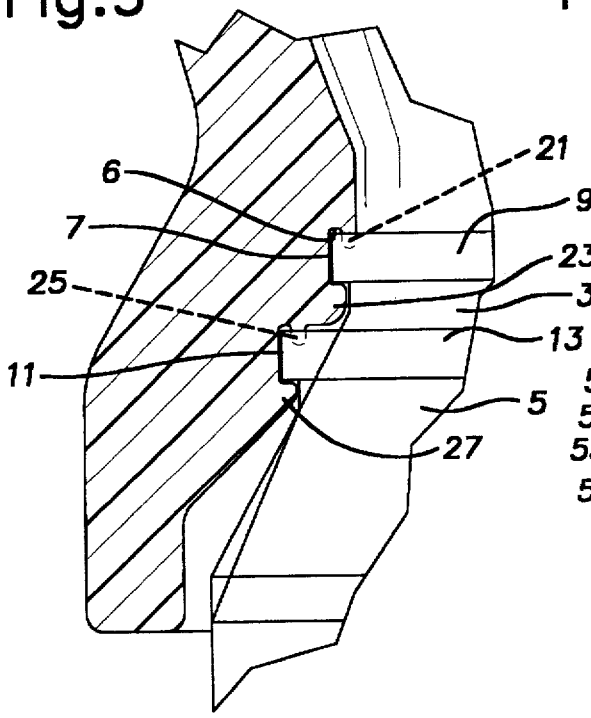
FIG. 3 is an enlarged scale cross-sectional view of a portion of FIG. 1 demonstrating two gripping collars or annular seal channels to illustrate how the invention can accommodate a plurality of beverage can top diameters while forming a snug and substantially liquid tight seal thereon.

Referring now to FIG. 3, within the substantially convex base, there is shown an upper annular circumference channel or gripping collar 7 comprising a vertical or upper rib 21, a horizontal rib 23, and the portion (including a vertical sidewall) connecting those two elements, forming a snug and substantially liquid tight seal over annular top rim or annular rim or top rim portion 9 of a smaller-sized diameter beverage can 3. Annular rim 9 is on the outer periphery of the top of can 3. Upper rib 21 engages the inner wall surface of rim 9. A lower annular circumference channel or gripping collar 11 comprising a vertical rib 25, a horizontal rib 27, and the portion (including a vertical sidewall) connecting those two elements, forming a snug and substantially liquid tight seal over annular top rim or annular rim or top rim portion 13 of a larger-sized diameter beverage can 5 is shown. The annular rims 9, 13, define different diameters.

Figure 3A:
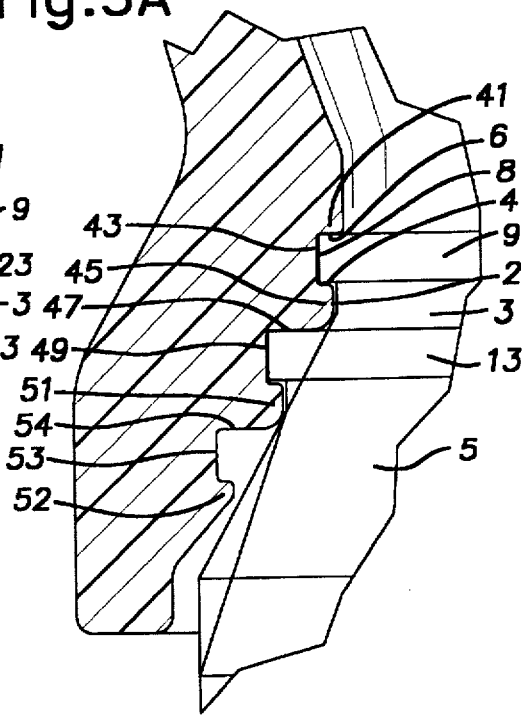
FIG. 3A is an enlarged scale cross-sectional view, similar to FIG. 3, of another form of our present invention demonstrating three gripping collars or annular seal channels with an alternative embodiment of the annular channels or gripping collars to illustrate how the invention can accommodate a plurality of beverage can top diameters while forming a snug and substantially liquid tight seal thereon.

Alternatively, referring now to FIG. 3A, the annular channels or gripping collars can be as shown where the vertical ribs 21 of gripping collar 7, and 25 of gripping collar 11 (see FIG. 3) have been omitted. The uppermost annular channel or gripping collar 43, comprising upper surface 41, horizontal rib 45, and the vertical sidewall portion connecting those two elements, forms a snug and substantially liquid tight seal over a top rim or top rim portion 9 of a smaller-sized diameter beverage can 3 by engaging the horizontal rib 45 below said rim, while the vertical sidewall of the gripping collar 43 and the upper surface 41 of the adjacent smaller upper circumference compress against said rim. A second annular channel or gripping collar 49, comprising upper surface 47, horizontal rib 51, and the vertical sidewall portion connecting those two elements, forms a snug and substantially liquid tight seal over a top rim or top rim portion 13 of a larger-sized diameter beverage can 5 by engaging the horizontal rib 51 below said rim, while the vertical sidewall of the gripping collar 49 and the upper surface 47 compress against said rim. Alternatively, the horizontal ribs, such as rib 51, can be shaped differently, so long as they perform the same function. For example, the distance between the vertical sidewall of 49 and the vertical sidewall of 53 can be much reduced, resulting in rib 51 being much thinner and pointer. Alternatively, these horizontal ribs can be shaped like a pyramid, lip, triangle, oval, rounded, long and thin rectangle, hook, flange, semi-circle, etc., oriented horizontally, vertically, diagonally, or in any other direction. In addition, a third annular channel or gripping collar 53, comprising upper surface 54, horizontal rib 52, and the vertical sidewall portion connecting those two elements, is disclosed allowing for the formation of a snug and substantially liquid tight seal over a top rim or top rim portion of a third even larger sized diameter beverage can by engaging or compressing the horizontal rib 52 below said rim, while the vertical sidewall of the gripping collar 53 and the upper surface 54 compress against said rim. Horizontal ribs 23, 27, 45, 51 and 52 preferably engage and compress against both the sidewall of the beverage can and the underside of the overhanging rim, see FIG. 3A. Alternatively, the horizontal rib may engage either the outer sidewall of the can or the bottom surface of the overhanging rim. With reference to FIG. 3A, the outer sidewall of can 3 is shown at 2 and the annular rim 9 overhangs outer sidewall 2 and has a bottom surface 4, an outer vertical sidewall 8, and a top surface 6 (top surface 6 being more clearly shown in FIG. 3). The horizontal ribs may also be referred to as lower ribs, since they engage beneath the overhanging rim. The vertical sidewalls of the collars may less preferably not engage the adjacent rim surface. Alternatively, a vertical sidewall of a collar may be longer (higher) than the height of an adjacent rim, in which case the rim may not touch the adjacent upper surface or the adjacent lower rib.

Figure 3B:
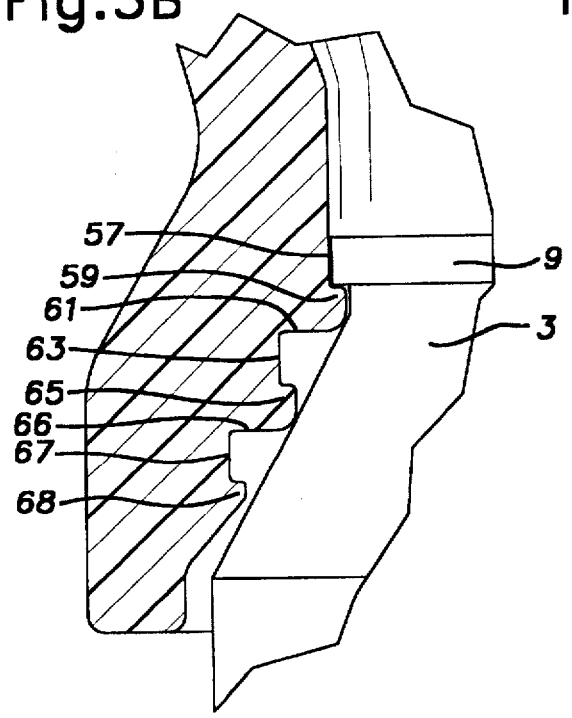
FIG. 3B is an enlarged scale cross-sectional view of another form of our present invention demonstrating three gripping collars with another alternative embodiment of the gripping collars to illustrate how the invention can accommodate a plurality of beverage can top diameters while forming a snug and substantially liquid tight seal thereon.

Alternatively, referring now to FIG. 3B, the annular channels or gripping collars can be as shown where the upper surface 41 in FIG. 3A has been omitted. Otherwise, FIG. 3B is basically identical to FIG. 3A. Gripping collar 57, comprising horizontal rib 59 and the adjacent vertical sidewall, engages top rim 9 and the sidewall of beverage can 3 as described above. Horizontal rib 59 engages can 3 below said rim 9, preferably with the bottom of said rim 9 engaging the uppermost surface of said rib 59 and rib 59 also engaging the outer vertical sidewall of can 3 as shown. The vertical sidewall of the gripping collar 57 compresses along said rim 9 as shown. Gripping collar 63, comprising upper surface 61, horizontal rib 65, and the vertical sidewall therebetween, and gripping collar 67, comprising upper surface 66, horizontal rib 68, and the vertical sidewall therebetween, function as the corresponding gripping collars in FIG. 3A. As can be seen, gripping collars 57, 63, and 67 are distinct from each other.

Figure 3C:
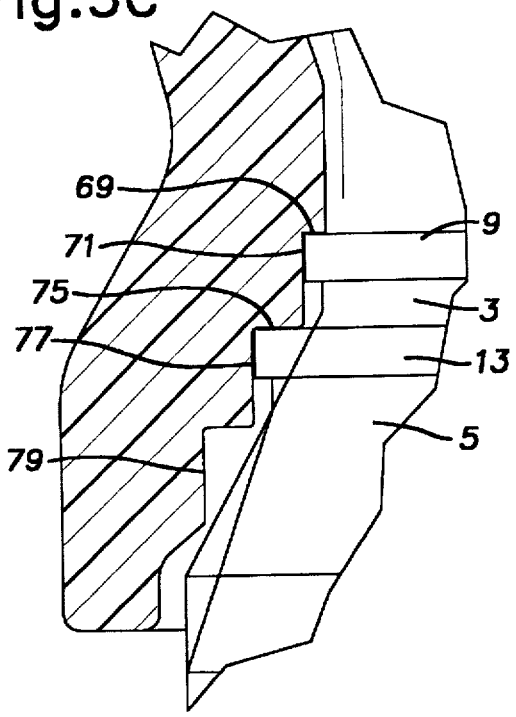
FIG. 3C is an enlarged scale cross-sectional view of another form of our present invention demonstrating three gripping collars with another alternative embodiment of the gripping collars to illustrate how the invention can accommodate a plurality of beverage can diameters while forming a snug and substantially liquid tight seal thereon.

Referring now to FIG. 3C, there is shown an alternative embodiment having a series of concentric gripping collars 71, 77, and 79, respectively. The uppermost gripping collar 71 forms a snug and substantially liquid tight seal against a top rim portion 9 of a smaller-sized diameter beverage can 3 by compression of the vertical sidewall of the gripping collar 71 against the adjacent rim. Preferably upper surface 69 acts as part of collar 71 by engaging the upper surface of the rim; alternatively, the rim may be spaced apart from and below surface 69, or the overhang forming surface 69 may be eliminated altogether, in these two cases compression being the force holding the can in place. A second gripping collar 77 forms a snug and substantially liquid tight seal against a top rim portion 13 of a larger-sized diameter beverage can 5 by compression of the vertical sidewall of the gripping collar 77 against the adjacent rim surface. The rim may be compressed against upper surface 75 or may be spaced apart therefrom. In addition, a third gripping collar 79, similar to collar 77 but accommodating a larger diameter can top, is provided.

Figure 4:
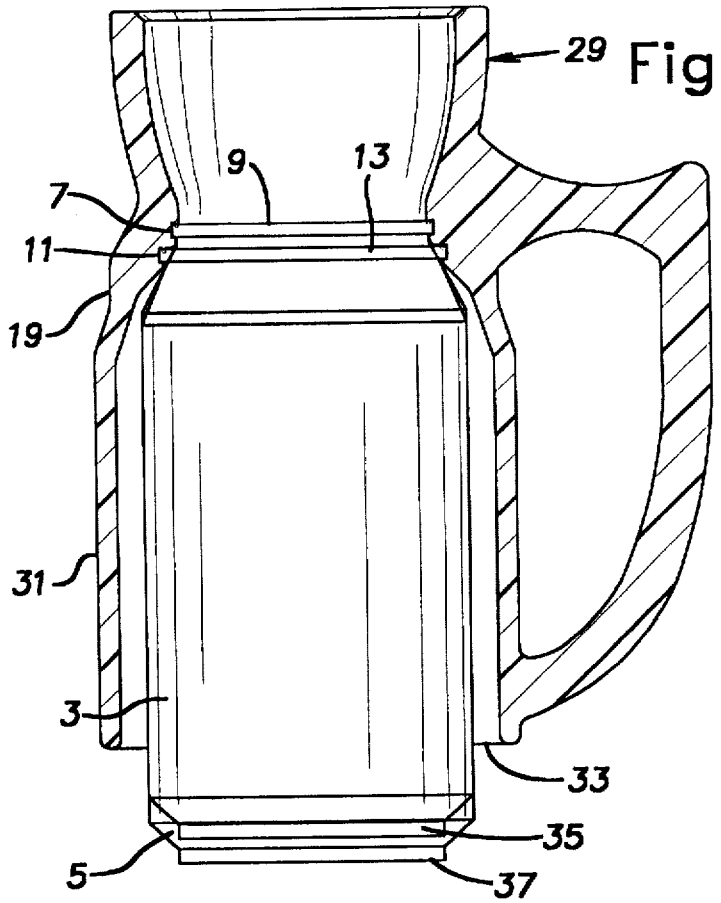
FIG. 4 is a cross-sectional view of another form of our present invention with a skirt portion extending downward from the base with integral C-shaped handle, mounted on top of a beverage can, with a second beverage can having a different size top diameter superimposed thereon.

Referring now to FIG. 4 there is shown an alternative embodiment of a detachable beverage can attachment 29 mounted atop a smaller-sized top diameter beverage can 3 and a larger-sized top diameter beverage can 5. A gripping collar 7 is adapted to provide a substantially liquid-tight seal over a top rim portion 9 of a smaller-sized diameter beverage can 3. A lower gripping collar 11 is adapted to provide a substantially liquid-tight seal over a top rim portion 13 of a larger-sized diameter beverage can 5. The attachment 29 is constructed with a lower skirt-like portion 31 emanating from said base portion 19 and concluding at a lower edge portion 33 at a point somewhat above a smaller-sized diameter beverage can base portion 35 and a larger-sized diameter beverage can base portion 37.

Figure 5:
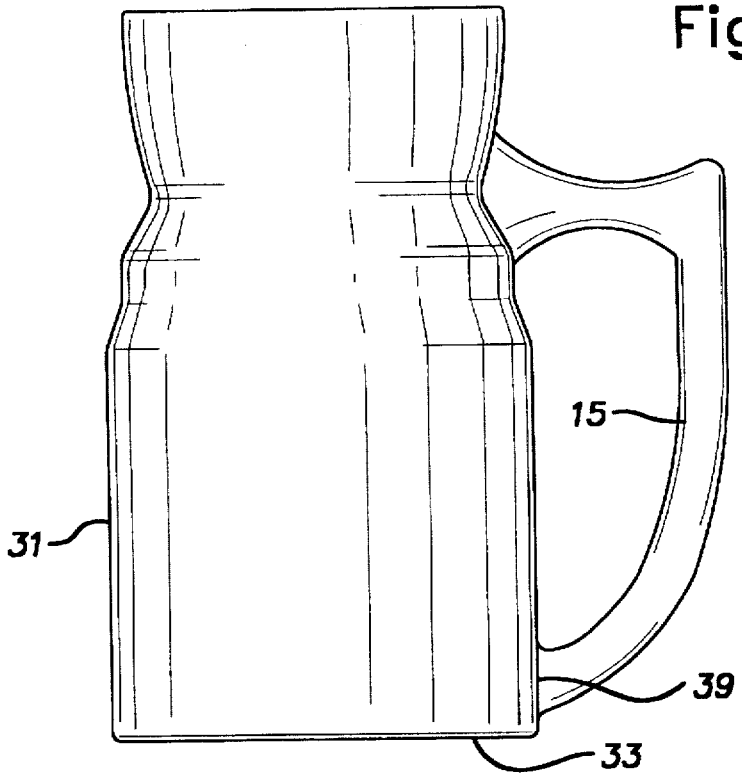
FIG. 5 is a side elevational view showing another form of our present invention with a skirt portion extending downward from the base and intersecting with the bottom portion of the integral C-shaped handle.

Referring now to FIG. 5 there is shown an approximately C-shaped integral handle 15 reuniting with the skirt at a point 39 slightly above the bottom edge portion 33 of the skirt 31.

The invented attachment may have 2, 3, 4, or possibly more, different gripping collars, preferably each of a different diameter to accommodate a different sized beverage can top, the collars preferably being arranged concentrically and pyramidally, with smaller ones on top of the larger ones, as illustrated. A gripping collar functions like the gripping collars described herein, to sealingly engage the top of a beverage can, sealingly engaging either the rim or the upper outer sidewall of the can beneath the rim, or a combination thereof. In the preferred embodiments the gripping collar consists of (1) upper surface, vertical sidewall, and lower or horizontal rib; (2) upper surface and vertical sidewall; (3) vertical sidewall and lower rib; (4) vertical sidewall; or (5) upper surface and lower rib.

Thus, there has been disclosed a detachable beverage can attachment that engages with the top rim portion of various top diameter and circumference beverage cans. The attachment is preferably integrally molded of resilient, slightly compressible material such as foam rubber with a skin, so the close, liquid-tight engagement can be achieved. Alternatively, various plastics, rubbers, and elastomers can be used. While several embodiments of the invention have now been made clear in an illustrative embodiment, these should not be construed as limitations on the scope of the invention but as merely providing illustrations of some of the preferred embodiments of this invention. For example, the top portion of the attachment can have other shapes, such as oval, triangular, etc., or can be shaped in the form of well-known or novel characters of movies, television or literature; the handle and base can have other shapes than just those of the preferred embodiment, etc.

Furthermore, it will be appreciated that the invention is capable of still further modifications, and the claims are intended to cover any alterations, uses, adaptations, or variations of the invention which are within the claim language. The scope of the invention should therefore be determined by the appended claims and their legal equivalents rather than by the examples given.

What is claimed is:

1. A detachable beverage can attachment adapted to be coupled, at different times, with the tops of first and second metal beverage cans to direct liquid from each of said beverage cans to a drinker's mouth, the top of said first beverage can having a first annular rim defining a first diameter, the top of said second beverage can having a second annular rim defining a second diameter, said first diameter being different from said second diameter, said beverage can attachment comprising: a top portion and a base, said top portion and base being integrally molded of resilient material, said top portion being capable of directing liquid from each of said beverage cans to a drinker's mouth, said base extending from said top portion, said base and said top portion defining an aperture, said base defining at least a first gripping collar and a second gripping collar, said first gripping collar being effective to form a first substantially liquid tight connection with the top of said first beverage can, said second gripping collar being distinct from said first gripping collar and being effective to form a second substantially liquid tight connection with the top of said second beverage can, said beverage can attachment further comprising a skirt extending from said base, said skirt being effective, when said beverage can attachment is coupled with said first beverage can, to extend along an outer sidewall of said first beverage can and substantially conceal said first beverage can from direct sunlight and substantially restrict viewing of a trademark or logo on said first beverage can and provide a substitute surface capable of affixation with advertisements such as characters, logos, and trademarks.

2. A beverage can attachment according to claim 1, further comprising a handle.

3. A beverage can attachment according to claim 2, said top portion, base, and handle being integrally molded of resilient material, said handle having two ends, one end of said handle being joined to a lower portion of said skirt.

4. A beverage can attachment according to claim 1, said first gripping collar being effective to form a first substantially liquid tight connection with said first annular rim, said second gripping collar being effective to form a second substantially liquid tight connection with said second annular rim.

5. A beverage can attachment according to claim 1, said first beverage can having a first outer sidewall, said first annular rim overhanging said first outer sidewall and having a first bottom surface, said first gripping collar comprising a first lower rib, said first lower rib being adapted to engage said first bottom surface of said first rim and being adapted to engage said first outer sidewall immediately below said first rim, said second beverage can having a second outer sidewall, said second annular rim overhanging said second outer sidewall and having a second bottom surface, said second gripping collar comprising a second lower rib, said second lower rib being adapted to engage said second bottom surface of said second rim and being adapted to engage said second outer sidewall immediately below said second rim.

6. A beverage can attachment according to claim 4, said first gripping collar comprising a first vertical sidewall, said first annular rim having a first outer vertical sidewall, said first vertical sidewall being adapted to engage said first outer vertical sidewall to form a substantially liquid tight connection, said second gripping collar comprising a second vertical sidewall, said second annular rim having a second outer vertical sidewall, said second vertical sidewall being adapted to engage said second outer vertical sidewall to form a substantially liquid tight connection.

7. A beverage can attachment according to claim 1, said beverage can attachment being adapted to be coupled with the top of a third metal beverage can to direct liquid from said third beverage can to a drinker's mouth, the top of said third beverage can having a third annular rim defining a third diameter different from each of said first and second diameters, said base further defining a third gripping collar, said third gripping collar being distinct from each of said first and second gripping collars and being effective to form a third substantially liquid tight connection with the top of said third beverage can.

8. A detachable beverage can attachment adapted to be coupled, at different times, with the tops of first and second metal beverage cans to direct liquid from each of said beverage cans to a drinker's mouth, the top of said first beverage can having a first annular rim defining a first diameter, the top of said second beverage can having a second annular rim defining a second diameter, said first diameter being different from said second diameter, said beverage can attachment comprising: a top portion and a base, said top portion and base being integrally molded of resilient material, said top portion being capable of directing liquid from each of said beverage cans to a drinker's mouth, said base extending from said top portion, said base and said top portion defining an aperture, said base defining at least a first gripping collar and a second gripping collar, said first gripping collar being effective to form a first substantially liquid tight connection with the top of said first beverage can, said second gripping collar being distinct from said first gripping collar and being effective to form a second substantially liquid tight connection with the top of said second beverage can, said first beverage can having a first outer sidewall, said first annular rim overhanging said first outer sidewall and having a first bottom surface, said first gripping collar comprising a first lower rib, said first lower rib being adapted to engage said first bottom surface of said first rim and being adapted to engage said first outer sidewall immediately below said first rim, said second beverage can having a second outer sidewall, said second annular rim overhanging said second outer sidewall and having a second bottom surface, said second gripping collar comprising a second lower rib, said second lower rib being adapted to engage said second bottom surface of said second rim and being adapted to engage said second outer sidewall immediately below said second rim, said first annular rim having a first top surface, said first gripping collar comprising a first upper surface, said first upper surface being adapted to engage said first top surface.

9. A beverage can attachment according to claim 8, said first gripping collar being effective to form a first substantially liquid tight connection with said first annular rim, said second gripping collar being effective to form a second substantially liquid tight connection with said second annular rim.

10. A beverage can attachment according to claim 9, said first gripping collar comprising a first vertical sidewall, said first annular rim having a first outer vertical sidewall, said first vertical sidewall being adapted to engage said first outer vertical sidewall to form a substantially liquid tight connection, said second gripping collar comprising a second vertical sidewall, said second annular rim having a second outer vertical sidewall, said second vertical sidewall being adapted to engage said second outer vertical sidewall to form a substantially liquid tight connection.

11. A beverage can attachment according to claim 8, said beverage can attachment being adapted to be coupled with the top of a third metal beverage can to direct liquid from said third beverage can to a drinker's mouth, the top of said third beverage can having a third annular rim defining a third diameter different from each of said first and second diameters, said base further defining a third gripping collar, said third gripping collar being distinct from each of said first and second gripping collars and being effective to form a third substantially liquid tight connection with the top of said third beverage can.

12. A beverage can attachment according to claim 8, said beverage can attachment further comprising a skirt extending from said base, said skirt being effective, when said beverage can attachment is coupled with said first beverage can, to extend along an outer sidewall of said first beverage can and substantially conceal said first beverage can from direct sunlight and substantially restrict viewing of a trademark or logo on said first beverage can and provide a substitute surface capable of affixation with advertisements such as characters, logos, and trademarks.

13. A beverage can attachment according to claim 8, further comprising a handle.

14. A beverage can attachment according to claim 13, said top portion, base, and handle being integrally molded of resilient material.

* * * * *

UNITED STATES PATENT AND TRADEMARK OFFICE

CERTIFICATE OF CORRECTION

PATENT NO. : 5,732,851
DATED : March 31, 1998
INVENTOR(S) : Patrick J. Griffin, et al.

It is certified that error appears in the above-identified patent and that said Letters Patent is hereby corrected as shown below:

Col. 1, line 20, "off" should be --of--.

Col. 1, line 43, "driver" should be --drinker--.

Col. 1, line 45, "cabot" should be --cannot-- and "driver" should be --drinker--.

Col. 1, line 54, "rising" should be --risking--.

Col. 1, line 58, "microorgasms," should be --microorganisms,--.

Col. 2, line 18, "channels" should be --hands--.

Col. 5, line 13, "Further" should be --drink--.

Col. 6, line 65, "pointer." should be --pointier--.

Signed and Sealed this

Thirteenth Day of October 1998

*Attest:*

Bruce Lehman

BRUCE LEHMAN

*Attesting Officer*

*Commissioner of Patents and Trademarks*